United States Patent [19]

Minnis et al.

[11] 4,382,591

[45] May 10, 1983

[54] CLAMPING MEANS FOR TROUGH OF PIPE HANDLING APPARATUS

[75] Inventors: C. W. Minnis; Hubert A. Hawkins; Wendell Davis, all of Forth Worth, Tex.

[73] Assignee: Ingram Corporation, New Orleans, La.

[21] Appl. No.: 192,477

[22] Filed: Sep. 30, 1980

[51] Int. Cl.[3] ..... E21B 19/14

[52] U.S. Cl. ..... 269/156; 269/238; 414/22; 414/745

[58] Field of Search ..... 414/22, 276, 745, 747, 414/748; 172/52, 85; 211/60 S; 248/49, 65, 74 R, 500, 507; 24/132 R; 269/156, 238

[56] References Cited

U.S. PATENT DOCUMENTS

| | | | |
|---|---|---|---|
| 3,058,533 | 10/1962 | Collins | 175/85 |
| 3,071,405 | 1/1963 | Koehler | 414/745 X |
| 3,734,210 | 5/1973 | Wilderman | 414/22 X |
| 3,741,517 | 6/1973 | Pogonowski | 269/156 X |
| 3,860,122 | 1/1975 | Cernosek | 414/747 X |
| 3,919,902 | 11/1975 | Johnson | 414/22 |
| 3,983,949 | 10/1976 | Pozniko | 175/85 |
| 4,264,267 | 4/1981 | Lüben | 414/748 |

*Primary Examiner*—Leslie J. Paperner

*Attorney, Agent, or Firm*—Lalos, Leeds, Keegan, Lett & Marsh

[57] ABSTRACT

Clamps are provided for clamping a length of pipe to the trough of a pipe handling apparatus. The clamps comprise two arms pivotally coupled to the trough on opposite sides thereof. The arms are movable to open and closed positions by two piston rods pivotally coupled to the arms and which are actuated by two cylinders pivotally coupled to the trough on opposite sides.

10 Claims, 18 Drawing Figures

101
27C
32
31
7
7
111
25
213
83
131
6
6
133
81
5
5
211
117
116
115
32
114
4
4
113

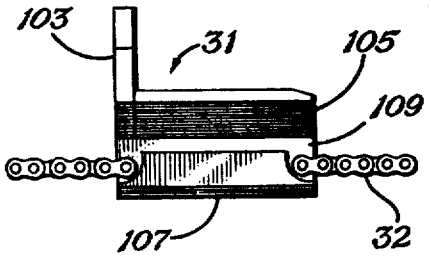
Fig. 9
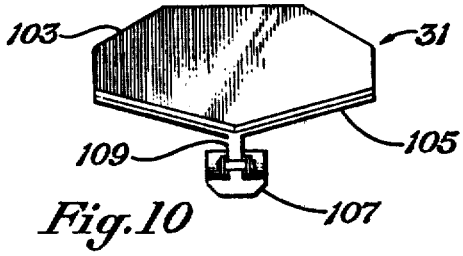
Fig. 10
Fig. 17
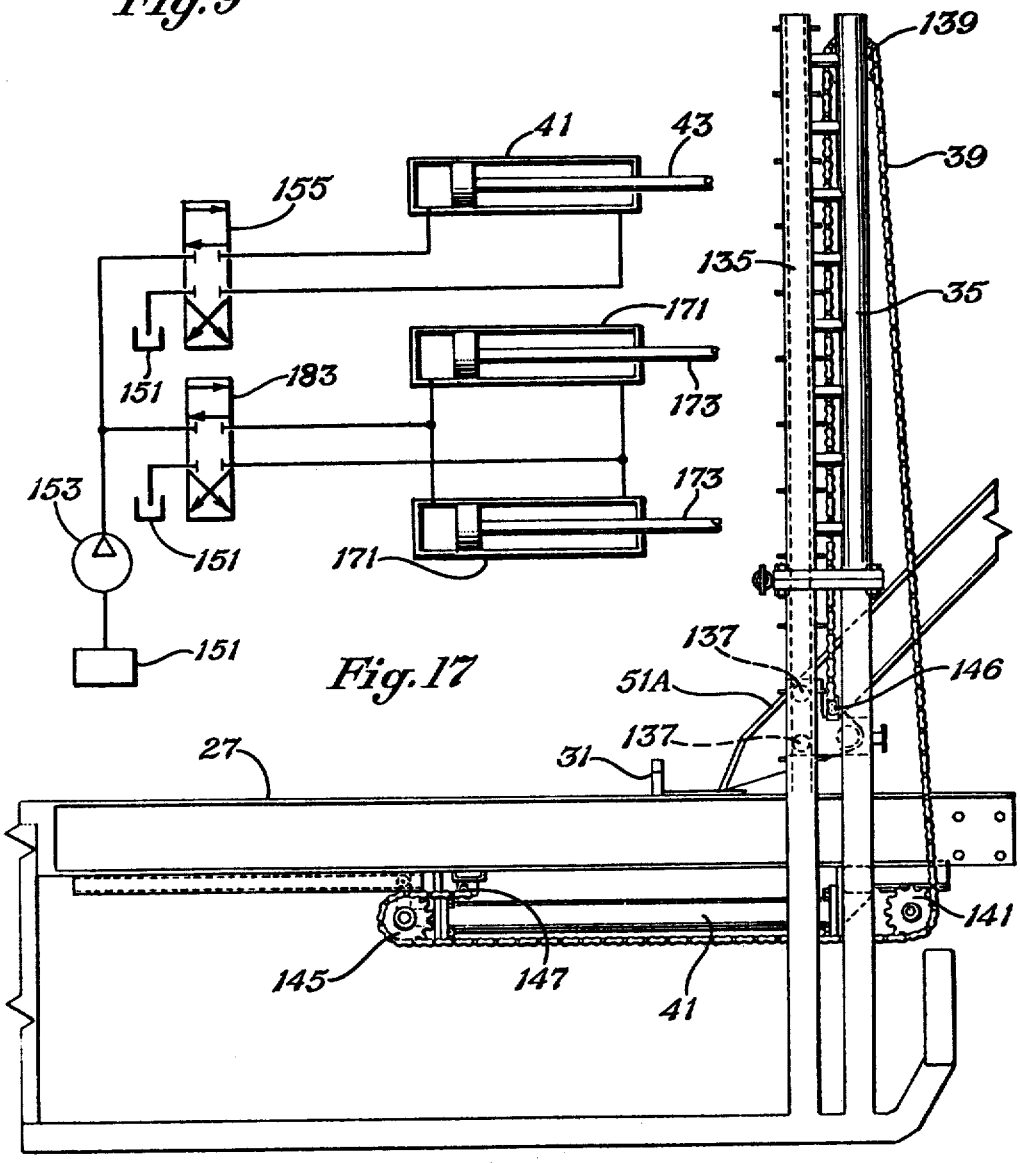
Fig. 11

Fig.15
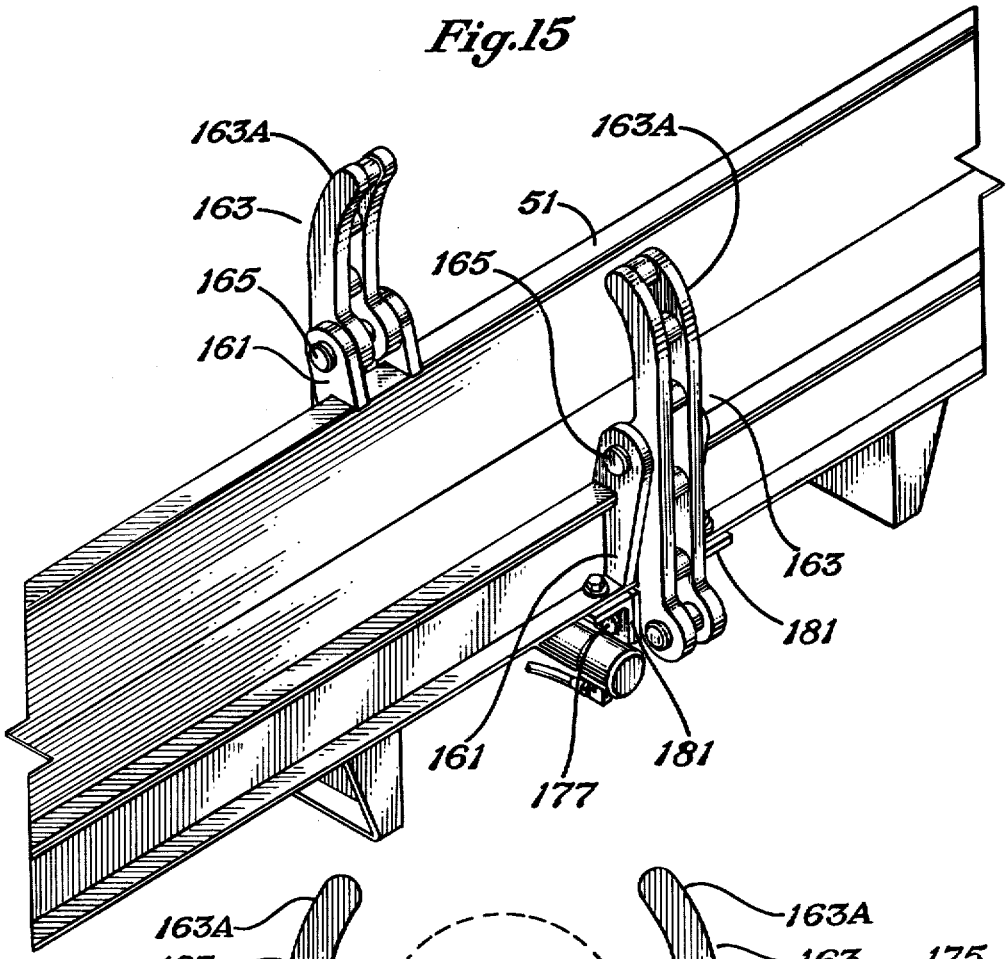
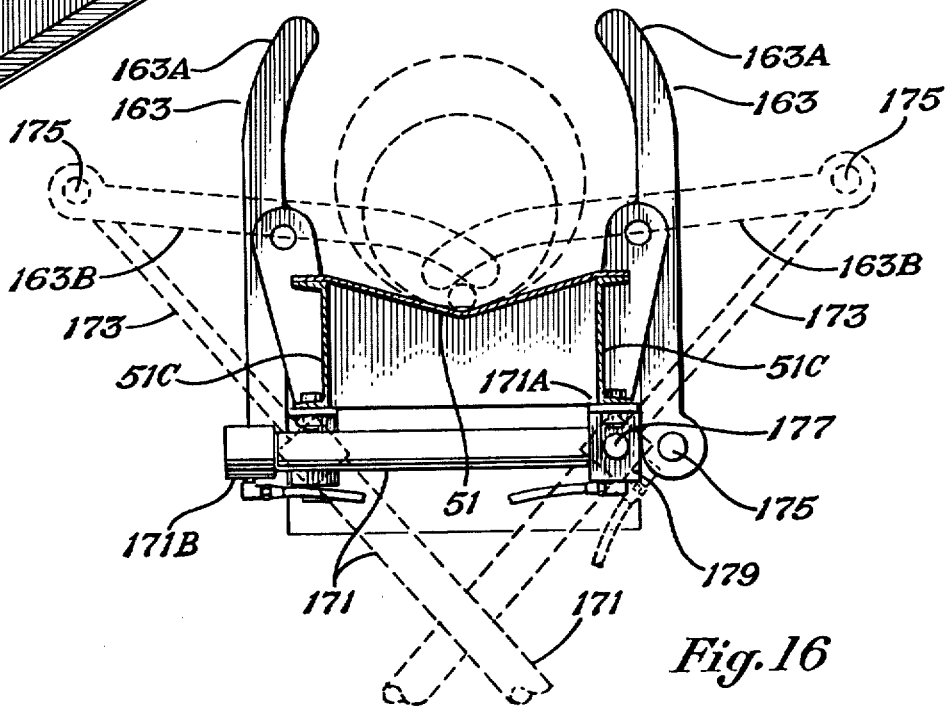
Fig.16

CLAMPING MEANS FOR TROUGH OF PIPE HANDLING APPARATUS

FIELD OF THE INVENTION

The present invention relates to a clamping means for clamping a length of pipe to a trough of a pipe handling apparatus.

DESCRIPTION OF THE PRIOR ART

U.S. Pat. Nos. Re. 28,071 and 3,810,553 disclose different brakes for slowing the descent of a pipe down a trough or chute of a pipe handling apparatus.

SUMMARY OF THE INVENTION

It is an object of the present invention to provide a new and useful clamping means for clamping a length of pipe or the like to the trough of a pipe handling apparatus.

The clamping means comprises two arms pivotally coupled to the trough on opposite sides thereof. The arms are movable to open and closed positions by two piston rods pivotally coupled to the arms and which are actuated by two cylinders pivotally coupled to the trough on opposite sides.

BRIEF DESCRIPTION OF DRAWINGS

In FIG. 7 all of the components of the apparatus at this end are not shown for purpose of clarity.

FIG. 9 is a side view of the pipe moving device of the stationary trough of the apparatus of FIG. 1.

FIG. 10 is an end view of the device of FIG. 9.

FIG. 11 is a side view of the system for lifting and lowering the rear end of the movable trough of the apparatus of FIG. 1.

FIGS. 15 and 18 are perspective views of pipe clamps of the present invention carried by the movable trough of FIG. 1.

FIG. 16 illustrates the manner of operation of the clamps of FIGS. 15 and 18.

FIG. 17 illustrates a hydraulic system for operating the lifting and lowering mechanism of FIG. 11 and the clamps of FIGS. 15, 16 and 18.

DESCRIPTION OF THE PREFERRED EMBODIMENT

Figure 1:
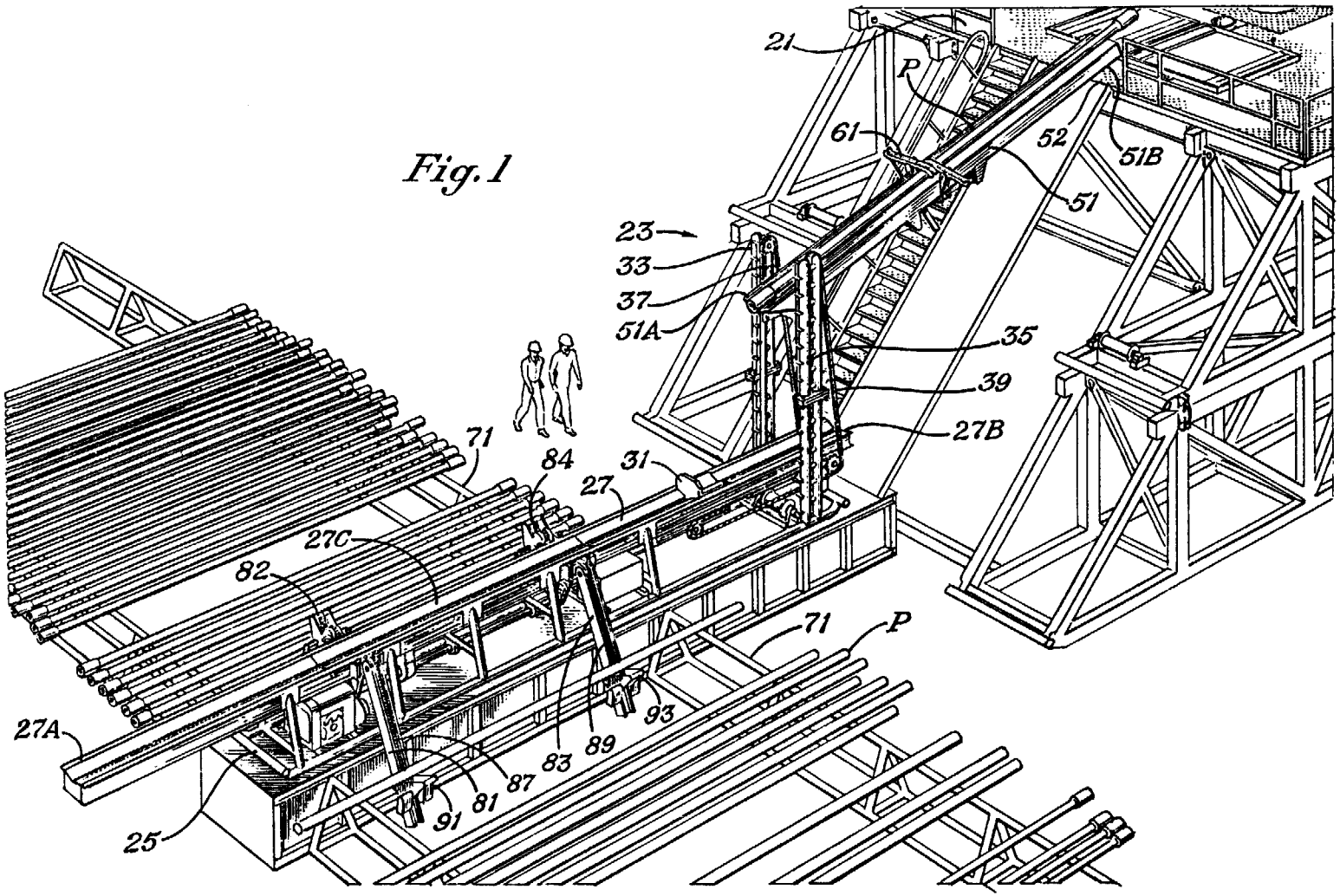
FIG. 1 is a perspective view of a pipe handling apparatus which incorporates the present invention.

Referring to the drawings, there will be described the pipe handling apparatus for raising pipe P such as casing, drill pipe, collars, or tubing up to a derrick floor 21 of a drilling rig 23 and for removing the pipe from the floor 21. The pipe handling apparatus comprises an elongated frame 25 which is adapted to extend toward the center of the rig and which supports a stationary trough 27 in a generally horizontal position below the level of the floor 21. The trough 27 is shaped for receiving pipe and has a rear end 27A and a front end 27B, the latter of which is located close to the base of the rig. A pipe moving device 31 is supported by the trough 27 for movement between its rear and front ends 27A and 27B. The device 31 is driven by an endless chain 32. Two upright members 33 and 35 are attached to the front end of the frame 25 and extend upward on opposite sides of the rear end 27B of the trough 27. The upright members 33 and 35, two chains 37 and 39, and a hydraulic cylinder 41 and piston rod 43 support the rear end 51A of a movable trough or chute 51 for vertical movement between a lower position as shown in FIG. 11 and an upper position as shown in FIG. 1. The front end 51B of the movable trough 51 is slidably supported by upper structure 52 at the rig floor 21. The movable trough 51 is V shaped for receiving pipe and is employed for lifting pipe from the stationary trough 27 to the rig floor 21 and for lowering pipe from the rig floor to the stationary trough 27. The trough 51 carries clamps or brakes 61 for clamping pipe to the trough 51 when it is raising or lowering pipe.

Figure 6:
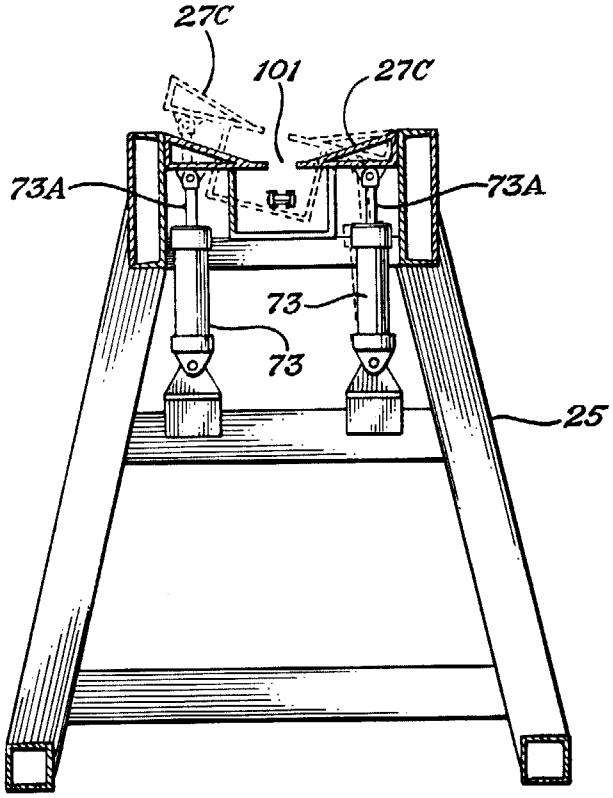
FIG. 6 is a cross-sectional view of FIG. 3 taken along the lines 6—6 thereof.
Figure 4:
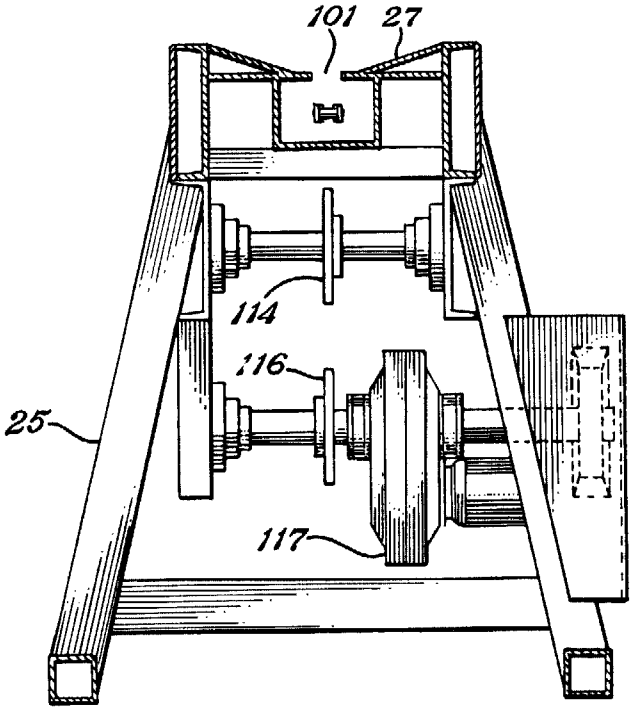
FIG. 4 is a cross-sectional view of FIG. 3 taken along the lines 4—4 thereof.

The pipe P is stored in racks 71 on both sides of the stationary trough 27. An intermediate portion 27C of the V shaped trough 27 is tiltable laterally in either direction to dump pipe on either side of the trough 27 for storage in the racks 71. The intermediate portion 27C is tiltable by hydraulic cylinders 73. As shown in FIG. 6, the cylinders 73 have their lower ends pivotally coupled to the frame 25 and their piston rods 73A pivotally coupled to the intermediate portion 27C. FIG. 6 illustrates the intermediate portion 27C being tilted laterally to the right.

Two pair of legs 81, 82 and 83, 84 coupled to the frame 25 extend downward at an incline from opposite sides of the intermediate portion 27C. Chains 87 and 89 having lugs 91 and 93 attached to their opposite ends are provided for lowering pipe from the trough 27 to the rack 71 or for lifting pipe P from the rack 71 to the trough 27. The chains 87 and 89 are driven simultaneously in one direction or the other to move the lugs 91 and 93 together either upward or downward for transferring pipe between the trough 27 and one of the racks 71.

When it is desired to move pipe from the right rack 71 (as seen in FIG. 1) upward to the rig floor 21, the following operations take place. The right lugs 91 and 93 will be in their lower positions; the pipe moving device 31 will be at the rear end 27A of the trough 27; the intermediate portion 27C of trough 27 will be in its normal non-tilted position; the rear end 51A of the movable trough 51 will be in its lower position; and the clamps 61 will be in their open positions. A length of pipe is rolled onto the right lugs 91 and 93 and the chains 87 and 89 are driven to move the lugs 91 and 93 upward. As the lugs 91 and 93 move upward the pipe slides against the legs 81 and 83 and is moved upward to the top of the legs where the pipe rolls into the trough 27. Movement of the chains 87 and 89 then is terminated to terminate further movement of the lugs 91 and 93. The pipe moving device 31 then is driven by the chain 32 toward the front end 27B of the trough 27. The device 31 will engage the end of the pipe and push it forward in the trough 27 and up into the trough 51. In its forward movement, the pipe slides in the trough 27 and then upward in the trough 51. In moving the pipe up into the trough 51, the device 31 is moved forward to a position as shown in FIG. 11. Movement of the chain 32 then is terminated to terminate further movement of the device 31. The clamps 61 then are closed to clamp the pipe to the trough 51. The rear end 51A of the trough 51 next is raised to its upper position. As the end 51A of the trough 51 is raised, its other end 51B slides forward on structure 52 at the rig floor 21. Cable hoists or elevators are attached to the pipe; the clamps 61 are opened and the pipe is lifted onto the derrick. The end 51A of the trough 51 is moved to its lower position; device 31 is moved to its rearward position; lugs 91 and 93 are moved downward and the process repeated.

In moving pipe downward from the rig floor 21, the clamps 61 are opened; the end 51A of the trough 51 is moved to its upper position; the device 31 is moved to a forward position as shown in FIG. 11; and the lugs 91 and 93 are moved to their upper positions. The cable hoist locates a length of pipe in the trough 51 and the clamps 61 are closed to clamp the pipe to the trough 51. The end 51A of the trough 51 is moved downward to its lower position. The clamps 61 are opened and the pipe slides down the trough 51 and onto the trough 27 until it engages the device 31. The device 31 is then moved rearward to allow the pipe to slide down the trough 51 until it is supported completely by the trough 27 where it will overlie the intermediate portion 27C. The intermediate portion 27C then is tilted laterally to dump the pipe onto the lugs 91 and 93 which then are lowered to lower the pipe onto the rack 71. The intermediate portion 27C is moved to its normal non-tilted position; the trough end 51A is raised; the device 31 is moved forward; the lugs 91 and 93 are raised and the process is repeated.

The pipe handling apparatus comprising the trough 51, and the lifting mechanism for the trough 51 has advantages in that transferring pipe to the floor of the rig will bring the end of the pipe closer to the center of the rig and at a lower working level enabling elevators to be used directly for handling the pipe eliminating the initial step of handling the pipe with cable hoists.

More detail of the pipe handling apparatus now will be described. The bottom of the trough 27 has an elongated slot 101 formed therethrough. Referring to FIGS. 9 and 10, the device 31 comprises a vertical plate 103 having V-shaped bottom member 105 which extends forward of the plate 103. The V-shaped member 105 slides in the trough 27. The forward side of the plate 103 engages the end of the pipe for pushing it or for allowing it to slide down trough 51. A lug 107 having a thin neck 109 extends from the bottom member 105. The neck 109 extends through the slot 101 and the lug 107 is connected to the chain 32 below the trough 27.

Figures 2, 3:
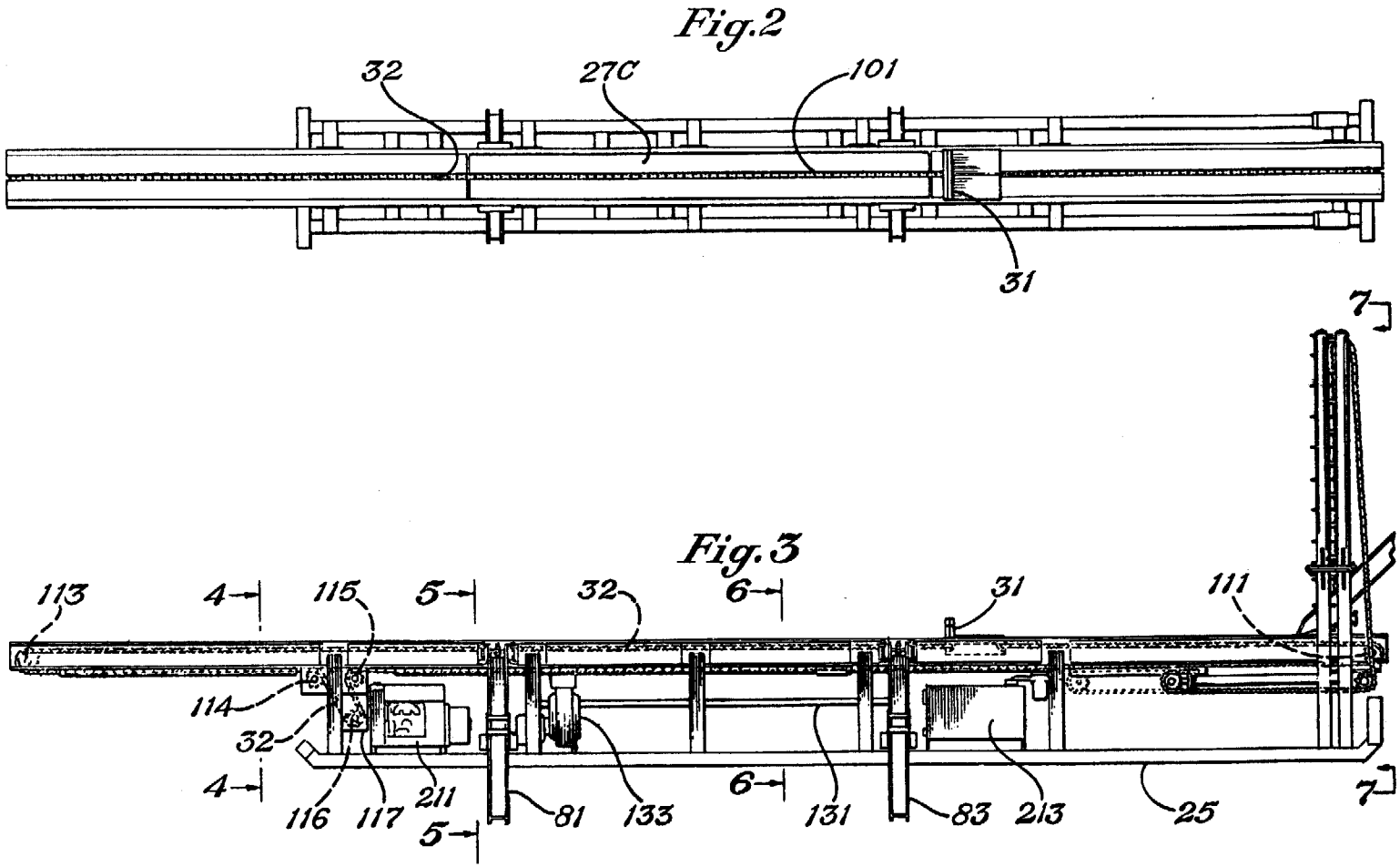
FIG. 2 is a top view of the stationary trough of the apparatus of FIG. 1.
FIG. 3 is a side view of the stationary trough of FIG. 3.

Referring to FIG. 3, the chain 32 extends around forward and rearward sprockets 111 and 113, around sprockets 114, 115, and 116 the latter of which is driven by a hydraulic driven reducer 117.

Figure 5:
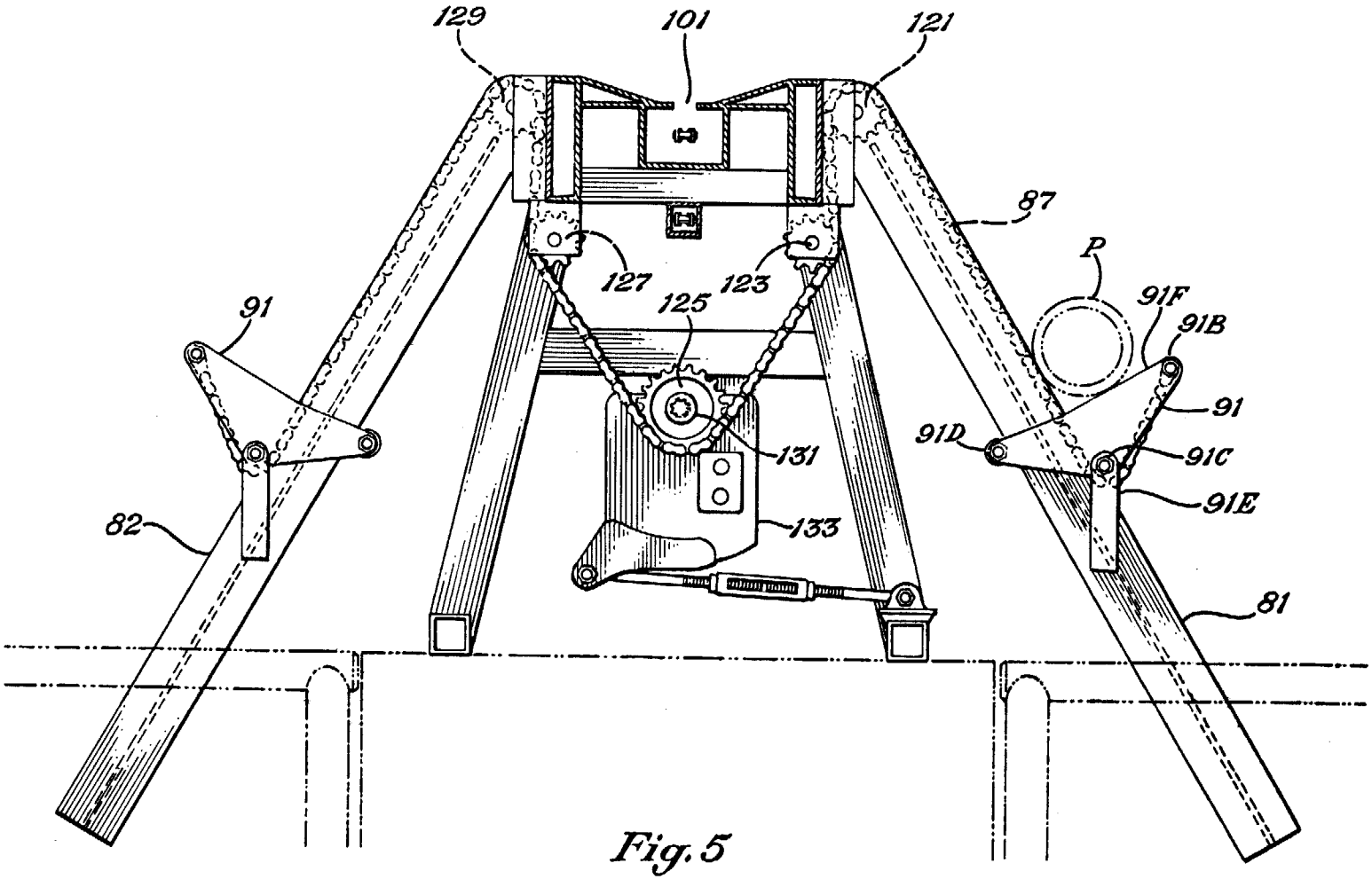
FIG. 5 is a cross-sectional view of FIG. 3 taken along the lines 5—5 thereof.
Figure 8:
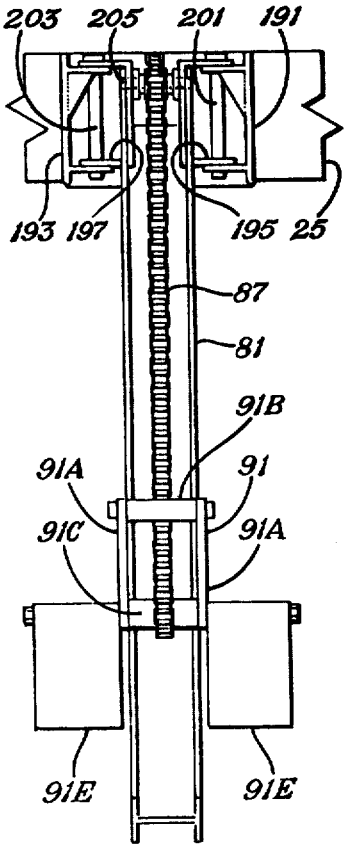
FIG. 8 is a side view of one of the legs of the apparatus of FIG. 1.
Figure 7:
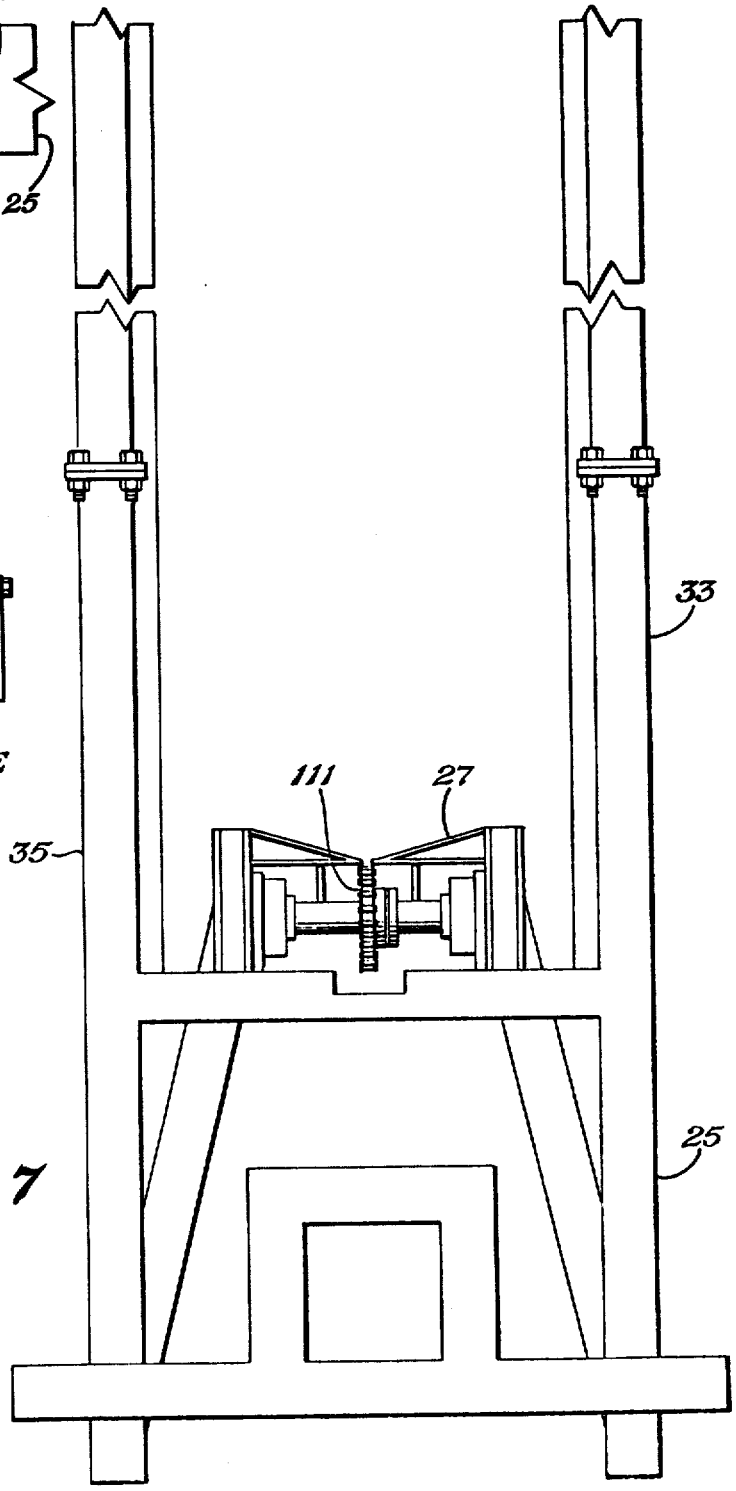
FIG. 7 is an end view of FIG. 3 as seen from lines 7—7 thereof.
Figure 12:
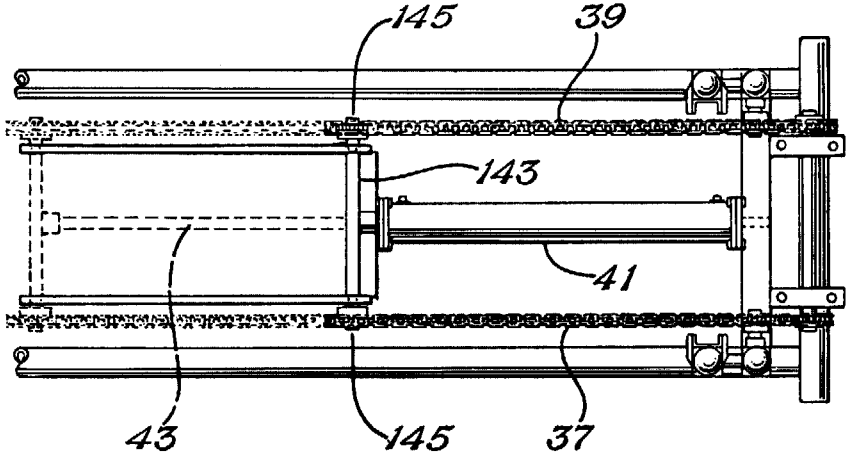
FIG. 12 is a bottom view of the lifting and lowering device of FIG. 11.
Figure 13:
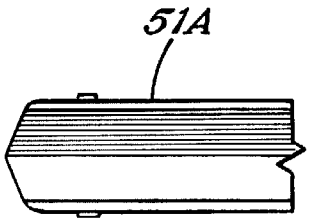
FIG. 13 is a top view of the rear end of the movable trough of FIG. 1.
Figure 14:
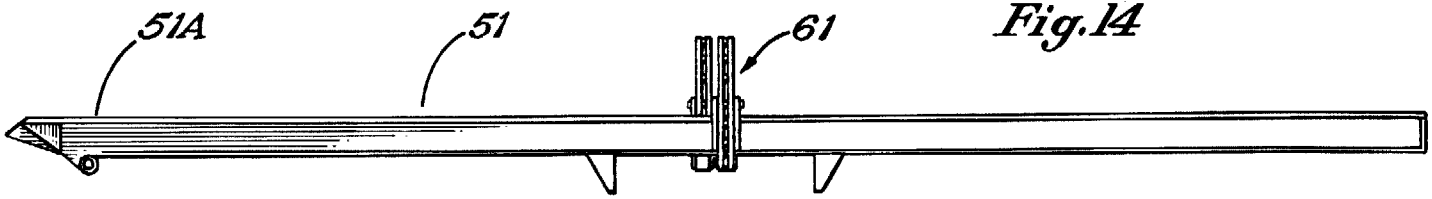
FIG. 14 is a side view of the movable trough of FIG. 1.
Figure 18:
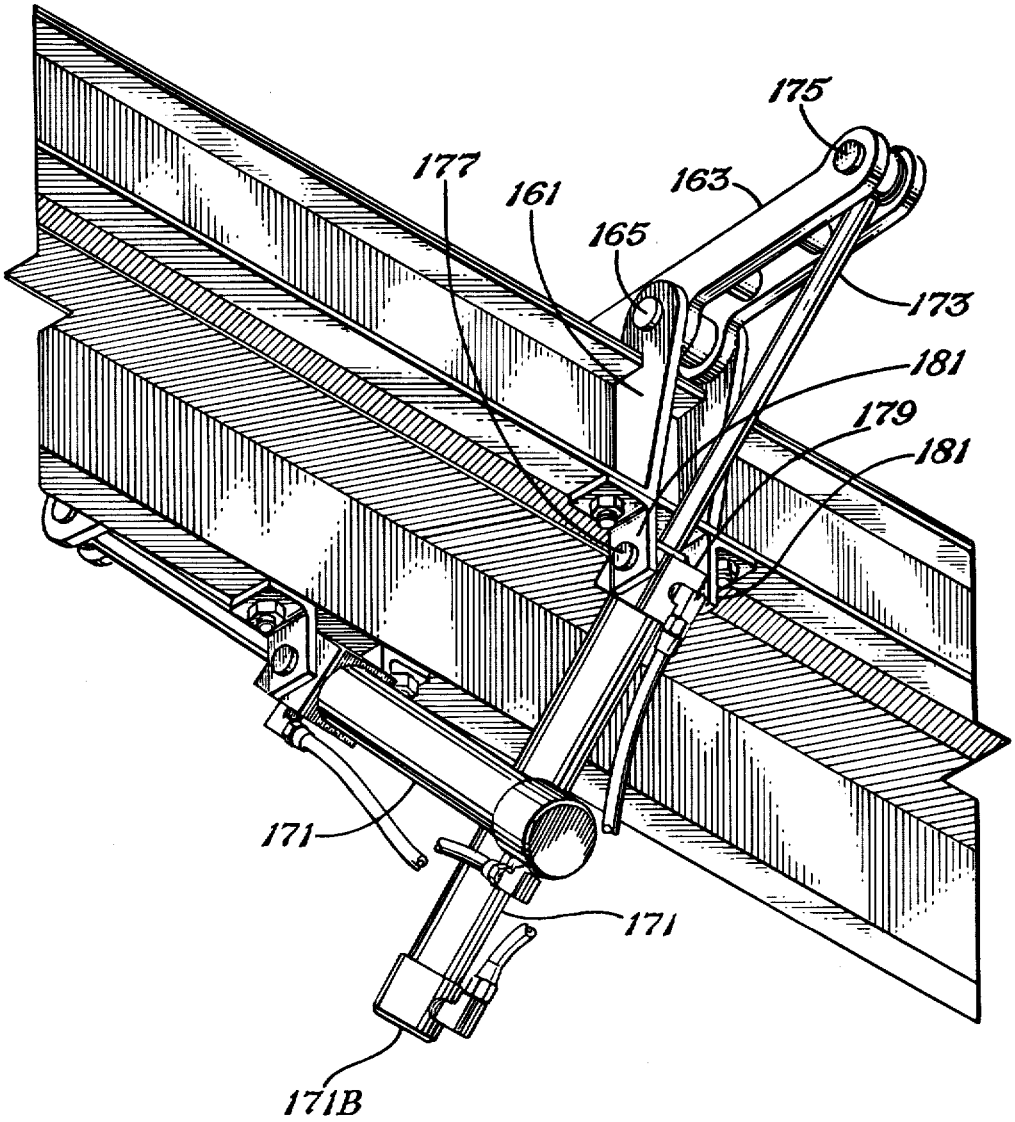

Referring to FIGS. 5 and 8, lugs 91 are formed of parallel plates 91A which straddle their legs 81 and 82. The plates 91A are coupled together by members 91B, 91C, and 91D. Members 91E are weights which are pivotally coupled to the plates 91A to maintain the plates 91A in a position such that their edges 91F face upward. The chain 87 has each end connected to member 91B and extends around member 91C of each of its lugs 91. The chain 87 extends around sprockets 121, 123, driven sprocket 123, and sprockets 127 and 129. Sprocket 125 is connected to a shaft 131 which is driven in either direction by a hydraulic driven reducer 133. The lugs 93 are formed in the same manner as lugs 91 and their chain 89 is supported in the same manner as chain 87. The shaft 125 drives both chains 87 and 89 simultaneously in either direction.

Referring to FIGS. 11–14 and 17 the mechanism for lifting and lowering the end 51A of the trough 51 will be described. Each upright member 33 and 35 extends vertically upward and has a channel guide 135 secured to its inside surface. Each side of the trough end 51A has two rollers 137 secured thereto which are fitted and roll in its associated guide 135. Thus as the trough end 51A moves upward it moves vertically causing its opposite end 51B to slide forward on structure 52 bringing the pipe closer to the center of the rig. Although not shown, guide means will be provided at structure 52 for guiding the rear end 51B of the trough 51 as it slides on structure 52. Each upright member 33 and 35 support an upper rotatable sprocket 139. A lower rotatable sprocket 141 is supported on each side of the frame 25 below the trough 27 and next to its associated upright member. The cylinder 41 is supported by the frame below the trough such that its piston rod 43 moves outward toward the rear end 27A of the trough 27 and inward toward the front end 27B of the trough. A cross bar 143 is connected to the piston rod 43. The bar 143 carries two rotatable sprockets 145 at its opposite ends, respectively. The chains 37 and 39 are connected to opposite sides of the trough end 51A at 146, extend around their associated upper and lower sprockets 139 and 141, around their associated sprocket 145 carried by the piston rod cross-bar 143 and are connected to the frame 25 at positions illustrated at 147. As the piston rod 143 moves outward of its cylinder 41, the chains 37 and 39 pull the trough end 51A upward to its upper position and as the piston rod 43 moves into its cylinder 41, the chains 37 and 39 allow the trough end 51A to move downward to its lower position. With this arrangement the trough end 51A is pulled upward twice the distance of outward travel of the piston rod 43.

Referring to FIG. 17, the hydraulic system for operating the cylinder 41 comprises an oil reservoir 151, a pump 153, a four way directional control valve 155, and appropriate flow lines.

Referring now to FIGS. 1, and 15–18 there will be described the clamps 61 for clamping a length of pipe to the trough 51. Brackets 161 are connected to opposite sides of the trough 51 about mid-way between its ends 51A and 51B. Each bracket 161 pivotally supports a clamping arm 163 for pivotal movement between open and closed positions. The arms 163 are pivotally coupled to the brackets 161 by way of pins 165. The arms 163 have curved clamping ends 163A for clamping a pipe to the trough 51. In FIG. 15 and as shown by the solid lines in FIG. 16, the arms 163 are in their maximum open positions. When moving toward their closed positions the clamping ends 163A of the arms 163 move toward each other to engage the pipe and clamp it to the trough 51. The different diameter dotted circles in FIG. 16 illustrate that the clamping arms may clamp different diameter pipe to the trough 51. In FIG. 16, the arms 163 are shown in dashed lines clamping a small diameter pipe to the trough 51.

Two hydraulic cylinders 171 are pivotally coupled to the lower edges of at opposite sides 51C, respectively, of the trough 51 for operating the arms 163. The cylinders have their piston rods 173 pivotally coupled to arm portions 163B at 175. Each of the cylinders 171 has only one end pivotally coupled to the lower edge of the trough. The end pivotally coupled to the trough is the end from which its piston extends. For example, in FIGS. 16 and 18, the cylinder shown on the right has its end 171A pivotally coupled to the trough 51 at 177. Its other end 171B is free to move in an arc as its piston rod moves inward or outward. The end 171A of the cylinder 171 has a sleeve 179 connected thereto and which is square in cross section. The sleeve is located between brackets 181 secured to the underside of the trough. The sleeve 179 is pivotally coupled to brackets 181 by two pins one of which is illustrated at 177.

When the piston rods 173 of the cylinders 171 are retracted, the cylinders are located below and perpendicular to the sides 51C of the trough 51 holding the arms 163 in their open positions. When the piston rods 173 are extended outward of their cylinders 171, the cylinders 171 pivot about their pivot axes 177 and their free ends 171B swing downward. The piston rods 173 move the ends 163B of the arms outward causing the clamping ends 163A to move inward to engage and clamp the pipe to the trough 51. The brackets 161 are mounted to the trough 51 in an offset relationship such that the arms 163 move in side-by-side parallel paths when they move between their open and closed positions. The clamping portions 163A have lengths such that they will cross each other when the arms are moved to their maximum closed positions.

Referring to FIG. 16 the hydraulic system for operating the cylinders 171 comprise the reservoir 151, pump 153 and a control valve 183.

Referring again to FIGS. 5 and 8, the legs 81, 82 and 83, 84 can be adjusted inward or outward and can be folded up against the frame 25 when the frame 25 and its trough 27 are being transported by truck on the road. The manner in which leg 81 is coupled to the frame 25 will be described. Each of the other legs 82–85 is coupled to the frame 25 in the same manner. Brackets 191 and 193 are fixedly connected to the frame on each side of the leg. Brackets 195 and 197 are coupled to brackets 191 and 193, respectively by removable pins 201 and 203. The leg 81 is pivotally coupled to brackets 195 and 197 for inward or outward pivotal movement about pivot pin 205. Thus the leg 81 can be pivoted inward or outward relative to brackets 195 and 197. In order to fold the leg against the frame 25, the chain 87 is disconnected from lug 91 and the pin 201 is removed. This allows the bracket 195, leg 81 and bracket 197 to pivot about pin 203 allowing the leg 81 to be folded against the frame 25.

Referring again to FIG. 3, member 211 is a diesel motor and hydraulic pump for operating the components of the apparatus. Member 213 is a hydraulic storage tank.

Instead of having the front end 51B of the trough 51 supported for sliding movement on structure 52 at the rig floor, it could be suspended with chains to allow it to swing forward and backward as the trough 51 is raised and lowered. As a further alternative, the front end 51B of trough 51 could be pivotally coupled to a linkage at the rig floor to allow it to move forward and backward as the trough 51 is raised and lowered.

We claim:

1. A pipe clamping apparatus for clamping a length of pipe or the like to a trough of a pipe handling apparatus comprising:

a pair of arms pivotally coupled to said trough on opposite sides thereof, said trough having a top surface for receiving a length of pipe, each said arm including a clamping portion and an opposite end, said arms being adapted to move toward each other to closed positions such that said clamping portions clamp a length of pipe to said top surface of said trough and to move away from each other and from said top surface to open positions such that a length of pipe can be positioned between or removed from between said clamping portions, and a pair of cylinders pivotally coupled to opposite sides of said trough, each said cylinder having a piston rod pivotally coupled to said opposite end of said arm on its associated side such that when said piston rods are extended said arms are moved to said closed positions and when said piston rods are retracted said arms are moved to said open positions, said cylinders each having first and second opposite ends with said piston rods extending out of said second ends, and said second ends of said cylinders being pivotally coupled to said trough such that said first ends are free to move as their piston rods are moved to their retracted or extended positions.

2. The pipe clamping apparatus according to claim 1 wherein, said cylinders are disposed at least partially underneath said trough when said piston rods are in said retracted positions.

3. The pipe clamping apparatus according to claim 2 wherein, said second ends of said cylinders are pivotally coupled to a bottom surface of said trough.

4. The pipe clamping apparatus according to claim 2 wherein, said cylinders are generally horizontal when said piston rods are in said retracted positions.

5. The pipe clamping apparatus according to claims 1 or 2 wherein, said clamping portions of said arms extend over said top surface of said trough when said arms are moved toward each other to said closed positions.

6. The pipe clamping apparatus according to claims 1 or 2 wherein, said arms are offset from each other such that they move in side-by-side parallel paths when said arms are moved between said open and closed positions.

7. The pipe clamping apparatus according to claims 1 or 2 wherein, said clamping portions have lengths such that they cross each other when said arms are moved to their maximum closed positions.

8. The pipe clamping apparatus according to claims 1 or 2 wherein, said clamping portions of said arms are curved toward said top surface of said trough.

9. The pipe clamping apparatus according to claims 1 or 2 wherein, said piston rods are adapted to extend simultaneously and to retract simultaneously.

10. The pipe clamping apparatus according to claims 1 or 2 further comprising:

a pivotal connection point for each said second end about which the corresponding said second end is pivotally attached to said trough, each said pivotal connection point being fixed relative to said trough.

* * * * *